US009865210B2

(12) United States Patent
Lee et al.

(10) Patent No.: US 9,865,210 B2
(45) Date of Patent: Jan. 9, 2018

(54) SELECTION CIRCUIT FOR INVERSION MODE AND DISPLAY DEVICE HAVING THE SAME

(71) Applicant: LG DISPLAY CO., LTD., Seoul (KR)

(72) Inventors: Woo Seock Lee, Gumi-si (KR); Ho Seop Shin, Paju-si (KR); Hak Su Kim, Daegu (KR); Joon Shik Yoon, Daegu (KR); Se Don Kim, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/973,147

(22) Filed: Dec. 17, 2015

(65) Prior Publication Data

US 2016/0180791 A1 Jun. 23, 2016

(30) Foreign Application Priority Data

Dec. 22, 2014 (KR) ..... 10-2014-0185808

(51) Int. Cl.
*G09G 3/36* (2006.01)

(52) U.S. Cl.
CPC ..... *G09G 3/3648* (2013.01); *G09G 3/3614* (2013.01); *G09G 2310/0297* (2013.01)

(58) Field of Classification Search
CPC ..... G09G 2310/0297
See application file for complete search history.

(56) References Cited

U.S. PATENT DOCUMENTS

2005/0134541 A1* 6/2005 Jang ..... G09G 3/3688 345/94
2013/0222216 A1* 8/2013 Park ..... G09G 3/3614 345/55

FOREIGN PATENT DOCUMENTS

CN 1648981 A 8/2005

* cited by examiner

*Primary Examiner* — Sanghyuk Park
(74) *Attorney, Agent, or Firm* — Birch, Stewart, Kolasch & Birch, LLP

(57) ABSTRACT

A display device according to an embodiment includes switches. Low and high voltages of a selection control signal applied to each of gate electrodes of the switches are varied according to whether one of positive and negative data voltages is applied to each of the source electrodes of the switches. As such, the swing width of the selection control signal can be maintained regardless of the positive and negative data voltages. In accordance therewith, undesired power consumption can be prevented.

14 Claims, 8 Drawing Sheets

SELECTION CIRCUIT FOR INVERSION MODE AND DISPLAY DEVICE HAVING THE SAME

The present application claims priority under 35 U.S.C. §119(a) of Korean Patent Application No. 10-2014-0185808 filed on Dec. 22, 2014, which is hereby incorporated by reference in its entirety.

BACKGROUND OF THE INVENTION

Field of the Disclosure

The present application relates to a selection circuit and a display device with the same.

Description of the Related Art

Display devices are being used to display images and information. Among the display devices, a liquid crystal display device displays an image by controlling light transmittance of liquid crystal using an electric field.

The liquid crystal display device includes a liquid crystal display panel and drivers configured to drive the liquid crystal display panel. The liquid crystal display panel includes a plurality of pixels which is defined by pluralities of gate lines and data lines and arranged in a matrix shape.

Liquid crystal molecules included in the liquid crystal display panel are re-aligned by the electric field. However, a long time is required to return the re-aligned liquid crystal molecules into an original state. To this end, inversion modes for preventing the deterioration of image quality are being used. The inversion mode can reduce the return time of the liquid crystal molecules using positive and negative data voltages.

A column inversion mode included in the inversion modes enables the positive and negative data voltages to be applied alternately with each other according to lines.

Recently, in order to reduce costs of the display device, the number of drivers tends to decrease. To this end, at least two data lines can be connected to each output channel of the driver. However, at least two data lines connected to each output channel of the driver largely increase power consumption.

BRIEF SUMMARY OF THE INVENTION

Accordingly, embodiments of the present application are directed to a selection circuit and a display device with the same that substantially obviate one or more of problems due to the limitations and disadvantages of the related art.

The embodiments are to provide a selection circuit and a display device with the same which are adapted to reduce power consumption.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

In order to solve or address the problems of the related art, a selection circuit according to a general aspect of the present embodiment includes a first selection cell and a second selection cell.

The first selection cell is connected to first through third selection control signal lines, a first source line and first, fifth and third data lines. Also, the first selection cell time-divides a positive data voltage applied from the first source line and multiplexes the time-divided positive data voltages to the first, fifth and third data lines, in response to first through third selection signals applied from the first through third selection control lines.

The second selection cell is connected to fourth through sixth selection control signal lines, a second source line and fourth, second and sixth data lines. Also, the second selection cell time-divides a negative data voltage applied from the second source line and multiplexes the time-divided negative data voltages to the fourth, second and sixth data lines, in response to fourth through sixth selection control signals applied from the fourth through sixth selection control signal lines.

Each of the first through third selection control signals includes a first pulse swinging between a first low voltage and a first high voltage, each of the fourth through sixth selection control signals includes a second pulse swinging between a second low voltage and a second high voltage. The first and second low voltages are different from each other, and the first and second high voltages are different from each other.

A display device according to another general aspect of the present embodiment includes a display panel, a pixel array, a data driver and a selection circuit. The selection circuit includes first and second selection cell with the above-mentioned configurations.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Reference will now be made in detail to the embodiments of the present disclosure, examples of which are illustrated in the accompanying drawings. Throughout this disclosure including the drawings, the same and like parts should be referred to as the same reference numbers and the overlapping description thereof can be omitted. Suffixes of component used in this disclosure can be defined or mixedly used for the convenience of explanation. In other words, the suffixes of the components have no meanings or functions distinguished from one another. In other instances, well-known technologies have not been described in detail in order to avoid obscuring the present disclosure. Also, the accompanying drawings are prepared in order to provide an understanding of the various embodiments of the present disclosure. As such, the technical spirits of the present disclosure are not limited to the accompanying drawings. In accordance therewith, it must be considered that the scope of the present disclosure includes various changes, modifications, equivalents and substitutes of the embodiments without departing from the technical spirit of the present disclosure.

Figure 1:
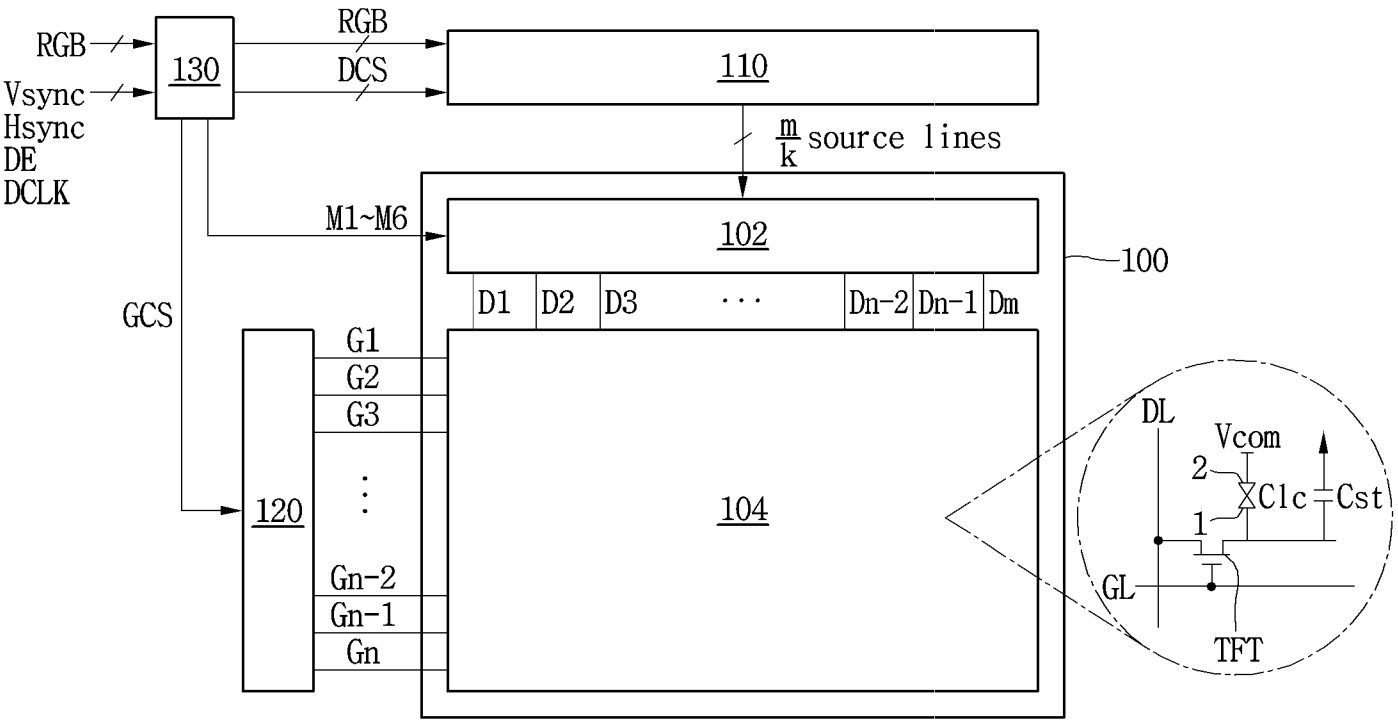
FIG. 1 is a block diagram showing a liquid crystal display device according to an embodiment of the present invention.

FIG. 1 is a block diagram showing a liquid crystal display device according to an embodiment of the present disclosure. All the components of the liquid crystal display device according to all the embodiments of the present disclosure are operatively coupled and configured.

Referring to FIG. 1, a display device according to an embodiment of the present disclosure can include a liquid crystal display panel 100, a data driver 110, a gate driver 120 and a timing controller 130.

The liquid crystal display panel 100 can include a pixel array 104 and a selection circuit 102 connected to the pixel array 104. The selection circuit 102 can be built in the liquid crystal display panel 100. In other words, the selection circuit 102 can be formed together with the pixel array 104 using a semiconductor procedure.

The pixel array 104 can be disposed on a display area. The selection circuit 102 can be disposed on a non-display area.

The liquid crystal display panel 100 includes liquid crystal molecules interposed between two glass substrates. In other words, the liquid crystal display panel 100 includes m×n liquid crystal cells Clc which are defined by crossing data lines D1~Dm and gate lines G1~Gn and arranged in a matrix shape. The 'm' and 'n' are positive integers.

The m data lines D1~Dm, the n gate lines G1~Gn and the pixel array 104 are formed on a lower glass substrate of the display panel 100. The pixel array includes thin film transistors, pixel electrodes 1 of the liquid crystal cells Clc, which are connected to the thin film transistors, storage capacitors Cst and so on. The pixel array can include a plurality of pixels used to display an image.

Each of the pixels can include a plurality of sub-pixels. For example, each of the pixels can include a red sub-pixel configured to display red, a green sub-pixel configured to display green and a blue sub-pixel configured to display blue. Alternatively, each of the pixels can have a quad configuration which includes a red sub-pixel, a green sub-pixel, a blue sub-pixel and a white sub-pixel being adjacent to one another.

A black matrix, a color filter layer and a common electrode 2 are formed on an upper glass substrate of the display panel 100. The common electrode 2 formed on the upper glass substrate allows the display panel 100 to be driven in a vertical field mode such as a twisted nematic mode or a vertical alignment mode. Alternatively, when the display panel 100 is driven in one of horizontal field modes such as an in-plane switching (IPS) mode, a fringe field switching (FFS) mode and so on, the common electrode 2 together with the pixel electrodes 1 can be formed on the lower glass substrate.

Also, the display panel 100 includes polarizing plates with light axes crossing each other. The polarizing plates are attached on outer surfaces of the lower and upper glass substrates. Moreover, the display panel 100 includes alignment films which are used to set a pretilt angle of the liquid crystal molecules. The alignment films are formed on inner surfaces of the lower and upper glass substrates which come in contact with the liquid crystal cells.

The data driver 110 can include a plurality of data (or source) driver integrated-circuit (IC) chips. The data driver 110 converts digital video data RGB into analog data voltages under a control of the timing controller 130. The data driver 110 can include k output channels which are used to output the data voltages. The 'k' is a positive integer smaller than 'm' and 'n'.

The selection circuit 102 is connected between the k output channels of the data driver 110 and the m data lines D1~Dm. In detail, the selection circuit 102 can be connected to the k output channels of the data driver 110 via k source lines. Such a selection circuit 102 can time-divide the data voltage, which is applied from an arbitrary output channel of the data driver 110, into 'p' data voltages. Also, the selection circuit 102 can multiplex the time-divided data voltages to p data lines. The 'p' is a positive integer larger than 1 but smaller than k.

For example, the selection circuit 102 can time-divide the data voltages on a source line S1, which is connected to an output channel of the data driver 110, and multiplex the time-divided data voltages to three data lines D1, D5 and D3, in response to three selection control signals M1, M2 and M3. Also, the selection circuit 102 can time-divide the data voltages on another source line S2, which is connected to another output channel of the data driver 110, and multiplex the time-divided data voltages to different three data lines D4, D2 and D6, in response to different three selection control signals M4, M5 and M6.

The 'p' can correspond to m/k.

The selection circuit 102 can includes a plurality of selection cells. The number of selection cells can be 'k'. Each of the selection cells can include a plurality of switches (TR1~TR3 or TR4~TR6 in FIG. 5). The number of switches included in the selection cell can be 'p' corresponding to a time division number. As such, each of the selection cells time-divides the data voltages applied from the respective output channel of the data driver 110 and multiplexes the time-divided data voltages to p data line.

In this manner, the data voltages output from one output channel of the data driver 110 can be multiplexed to p data lines by the selection circuit 102. In accordance therewith, the number of output channels of the data driver 110 can be reduced into 1/p of the data lines.

The gate driver 120 can sequentially select horizontal pixel lines of the pixel array 104 under the control of the timing controller 130. To this end, the gate driver 120 can sequentially generate scan pulses and apply the sequentially generated scan pulses to the gate lines G1~Gn. As such, the horizontal pixel lines of the pixel array 104 can be sequentially selected by the scan pulses on the gate lines G1~Gn and receive the data voltages. The horizontal pixel lines can include pixels arranged on the respective gate lines G1~Gn which are used to transfer the scan pulses.

Also, the gate driver 120 can include a shift register, a level shifter and so on as an example, even though it is not shown in the drawing. The level register can sequentially generate the scan pulses. The level shifter can shift a voltage level of the scan pulse to a voltage level which is suitable to drive the thin film transistors of the liquid crystal cells Clc. However, the gate driver 120 is not limited to this configuration.

Moreover, the gate driver 120 can be loaded on a TCP (tape carrier package) and bonded to the lower glass substrate of the display panel 120 through the TAB (tape automated bonding) process. Alternatively, the gate driver 120 can be disposed on the non-display area of the liquid crystal display panel 100 which is not occupied by the pixel array 104. In this case, the gate driver 120 can be simultaneously formed on the lower glass substrate of the liquid crystal display panel 100 through a gate-in-panel (GIP) procedure when the pixel array 104 is formed.

The timing controller 130 receives the digital video data RGB and timing signals from a host system (not shown). The timing signals can include a vertical synchronous signal Vsync, a horizontal synchronous signal Hsync, a data enable signal DE, a clock signal DCLK and so on.

Also, the timing controller 130 can derive scan control signals GCS and data control signals DCS from the timing signals. The scan control signals GCS are used to control the gate driver 120, and the data control signals DCS are used to control the data driver 110. The scan control signals GCS can include a gate start pulse, a gate shift clock, gate output enable signal and so on. The data control signals DCS can include a source start pulse, a source shift clock, a source output enable signal, a polarity control signal and so on. Such scan control signals GCS can be transferred from the timing controller 130 to the gate driver 120. The digital video data RGB and the data control signals DCS can be transferred from the timing controller 130 to the data driver 110.

Moreover, the timing controller 130 can further generate selection control signals M1~M6 using the vertical synchronous signal Vsync, the horizontal synchronous signal Hsync, the data enable signal DE and the clock signal DCLK. The selection control signals M1~M6 are used to control turn-on/off timings of a plurality of switches included in the selection circuit 102.

Figure 2:
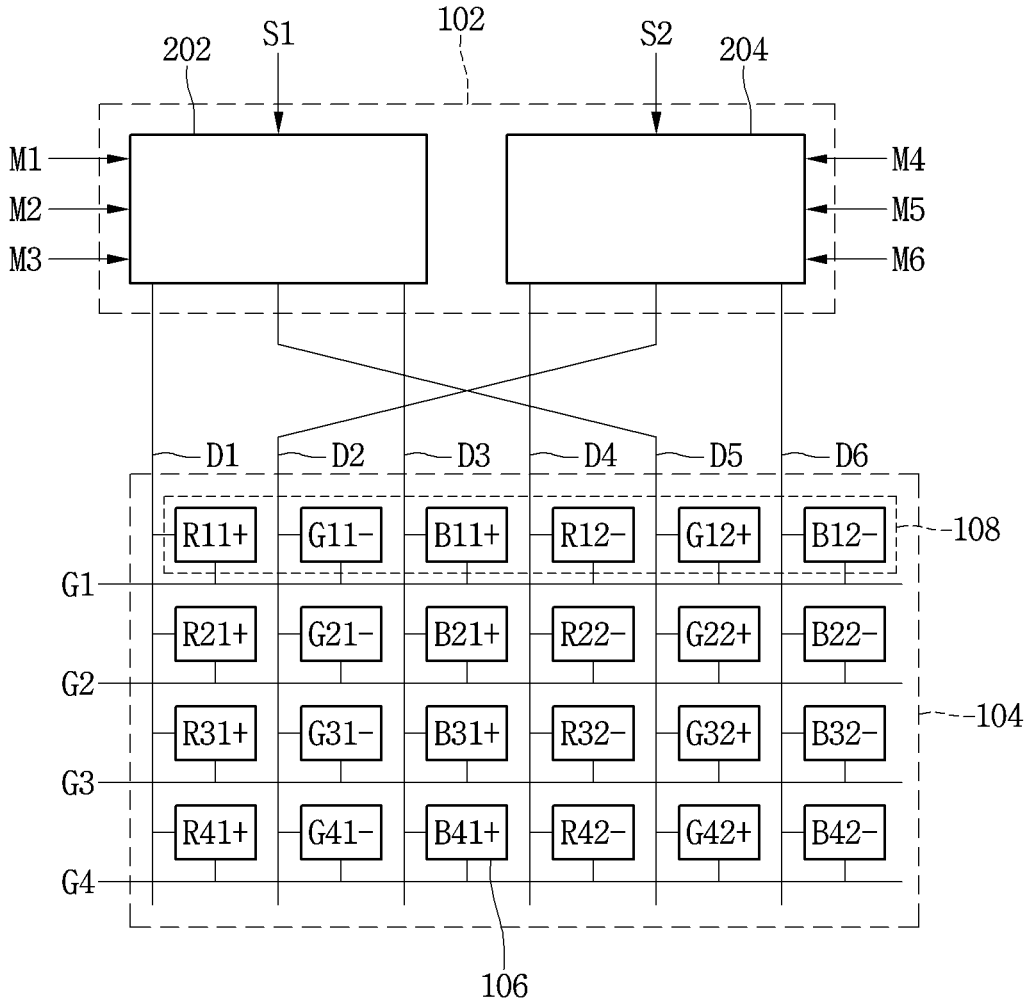
FIG. 2 is a circuit diagram showing in detail a part of the liquid crystal display panel shown in FIG. 1.

FIG. 2 is a circuit diagram showing in detail a part of the liquid crystal display panel shown in FIG. 1.

For the convenience of explanation, FIG. 2 shows a pixel array 104 including 8 pixels, i.e., 24 sub-pixels 106. However, the pixel array 104 can include m×n sub-pixels as shown in FIG. 1.

Also, a selection circuit 102 including only first and second selection cells 202 and 204 is shown in FIG. 2. However, the selection circuit 102 can include m/3 selection cells (i.e., k selection cells) on the basis of the liquid crystal display device of FIG. 1. As such, the first and second selection cells 202 and 204 can be odd-numbered and even-numbered selection cells.

Referring to FIG. 2, the liquid crystal display panel 100 can include a selection circuit 102 and a pixel array 104.

The pixel array 104 can include a plurality of sub-pixels 106. The data voltages transferred by the selection circuit 102 can be applied to the plurality of sub-pixels 106 of the pixel array 104 in a column inversion mode.

Figure 9:
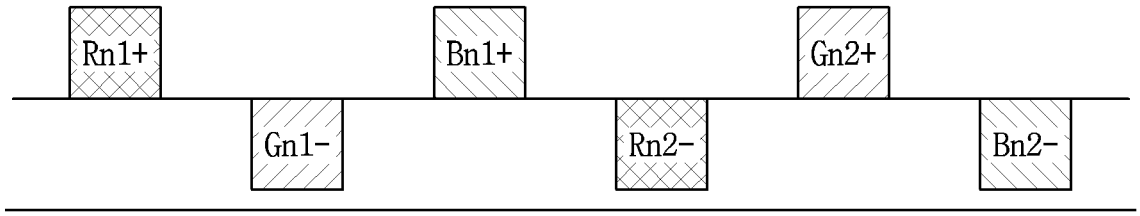
FIG. 9 is a waveform diagram illustrating a column inversion mode according to an example of the present invention.

For example, as shown in FIG. 9, first positive red data voltages Rn1+ can be applied to the sub-pixels 106 of a first vertical pixel line on a first data line D1, first negative green data voltages Gn1− can be applied to the sub-pixels 106 of a second vertical pixel line on a second data line D2, and first positive blue data voltages Bn1+ can be applied the sub-pixels 106 of a third vertical pixel line on a third data line D3. Also, second negative red data voltages Rn2− can be applied to the sub-pixels 106 of a fourth vertical pixel line on a fourth data line D4, second positive green data voltages Gn2+ can be applied to the sub-pixels 106 of a fifth vertical pixel line on a fifth data line D5, and second negative blue data voltages Bn2− can be applied the sub-pixels 106 of a sixth vertical pixel line on a sixth data line D6.

The selection circuit 102 can be formed in a non-display area adjacent to an edge of the pixel array 104. Also, the selection circuit 102 can be formed together with the pixel array 104 through a semiconductor procedure. Such a selection circuit 102 can include first and second (or odd-numbered and even-numbered) selection cells 202 and 204.

The first selection cell 202 can time-divide the data voltages applied from the first source line S1 and multiplex the time-divided data voltages to the first data line D1, the fifth data line D5 and third data line D3, in response to a first selection control signal group including first through third selection control signals M1 through M3. To this end, an input channel of the first selection cell 202 can be connected to the first source line S1, and control terminals of the first selection cell 202 can be connected to first through third selection control signal lines, and output channels of the first selection cell 202 can be connected to the first data line D1, the fifth data line D5 and the third data line D3.

The second selection cell 204 can time-divide the data voltages applied from the second source line S2 and multiplex the time-divided data voltages to the fourth data line D4, the second data line D2 and sixth data line D6, in response to a second selection control signal group including fourth through sixth selection control signals M4 through M6. To this end, an input channel of the second selection cell 204 can be connected to the second source line S2, and control terminals of the second selection cell 204 can be connected to fourth through sixth selection control signal lines, and output channels of the second selection cell 204 can be connected to the fourth data line D4, the second data line D2 and the sixth data line D6.

For example, a first horizontal pixel line 108 including a plurality of sub-pixels 106 can be selected when the scan pulse is applied to the first gate line G1. The first horizontal pixel line 108 can include first through sixth sub-pixels 106. In this case, a first positive red data voltage R11+ can be applied the first selection cell 202 to the first sub-pixel 106 via the first data line D1, a first negative green data voltage G11− can be applied from the second selection cell 204 to the second sub-pixel 106 via the second data line D2, and a first positive blue data voltage B11+ can be applied from the first selection cell 202 to the third sub-pixel 106 via the third data line D3. Also, a second negative red data voltage R12− can be applied from the second selection cell 204 to the fourth sub-pixel 106 via the fourth data line D4, a second positive green data voltage G12+ can be applied from the first selection cell 202 to the fifth sub-pixel 106 via the fifth data line D5, and a second negative blue data voltage B12− can be applied from the second selection cell 204 to the sixth sub-pixel 106 via the sixth data line D6.

In this manner, not only the second positive green data voltage G12+ can be applied from the first selection cell 202 to the fifth sub-pixel 106 via the fifth data line D5, but also the first negative green data voltage G11− can be applied from the second selection cell 204 to the second sub-pixel 106 via the second data line D2. As such, the first, third, fourth and sixth data lines D1, D3, D4 and D6 can be disposed to go straight from the respective selection cells 202 and 204 to the pixel array 104 with crossing one another, but the second and fifth data lines D2 and D5 can be disposed to cross each other between the selection cells 202 and 204 and the pixel array 104.

Figure 3:
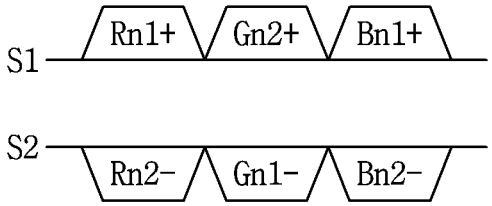
FIG. 3 is a waveform diagram showing data voltages on signal lines according to an example of the present invention.

As shown in FIG. 3, three positive data voltages including the first positive red data voltage Rn1+, the second positive green data voltage Gn2+ and the first positive blue data voltage Bn1+ can be applied from the first output channel (or an odd-numbered output channel) of the data driver 110 to the first source line S1 (or an odd-numbered source line). Also, three negative data voltages including the second negative red data voltage Rn2−, the first negative green data voltage Gn1− and the second negative blue data voltage Bn2− can be applied from a second output channel (an even-numbered output channel) of the data driver 110 to the second source line S2 (or an even-numbered source line). Wherein, the 'n' corresponds to the number of gate lines or horizontal pixel lines. In other words, the 'n' can preferably mean that a single frame can include n horizontal intervals nH. As such, as shown in FIG. 3, not only the first positive red data voltage Rn1+, the second positive green data voltage Gn2+ and the first positive blue data voltage Bn1+, which are transferred by the first source line S1, but also the second negative red data voltage Rn2−, the first negative green data voltage Gn1− and the second negative blue data voltage Bn2− which are transferred by the second source line S2 can be applied to the first and second selection cells 202 and 204 onetime every horizontal interval (or period), i.e., n times during a single frame.

Alternatively, not only three data voltages with positive, negative and positive polarities (+, − and +) can be applied to the first source line S1 connected to the first output channel of the data driver 110 but also three data voltages with negative, positive and negative polarities (−, + and −) can be applied to the second source line S2 connected to the second output channel of the data driver 110, even though they are not shown in the drawings. Also, not only three data voltages with negative, positive and negative polarities (−, + and −) can be applied to the first source line S1 connected to the first output channel of the data driver 110 but also three data voltages with positive, negative and positive polarities (+, − and +) can be applied to the second source line S2 connected to the second output channel of the data driver 110, even though they are not shown in the drawings. In other words, not only three data voltages each having the positive polarity (+) cannot be applied to the first source line S1 but also three data voltages each having the negative polarity (−) cannot be applied to the second source line S2.

As shown in FIG. 2, the second positive green data voltage Gn2+ input to the first selection cell 202 via the first source line S1 can be applied to from the first selection cell 202 to the fifth data line D5 of the pixel array 104. Also, the first negative green data voltage Gn1− input to the second selection cell 204 via the second source line S2 can be applied from the second selection cell 204 to the second data line D2 of the pixel array 104.

Figure 4:
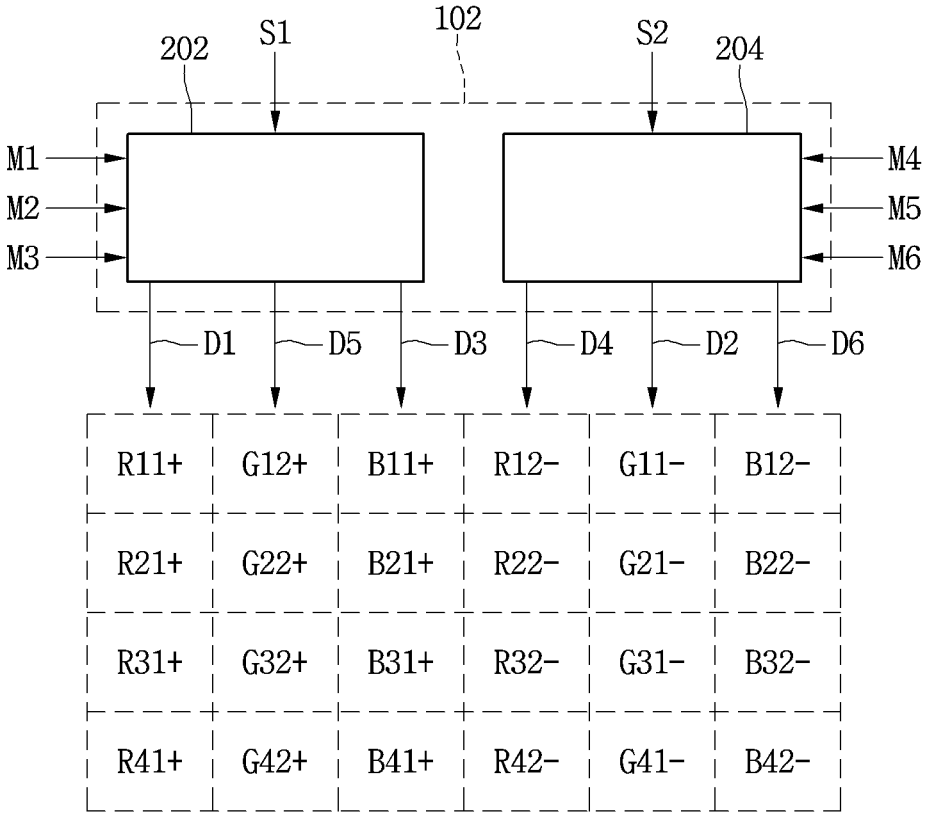
FIG. 4 is a block diagram showing the selection circuit shown in FIG. 1.

The first selection cell 202 responsive to the first through third selection control signals M1 through M3 can time-divide the data voltages Rn1+, Gn2− and Bn1+ applied from the first source line S1 and transfer the time-divided data voltage Rn1+, Gn2+ and Bn1+ to the first, fifth and third data lines D1, D5 and D3, as shown in FIG. 4. Also, the second selection cell 204 responsive to the fourth through sixth selection control signals M4 through M6 can time-divide the data voltages Rn2−, Gn1− and Bn2+ applied from the second source line S2 and transfer the time-divided data voltages Rn2−, Gn1− and Bn2− to the fourth, second and sixth data lines D4, D2 and D6.

Figure 5:
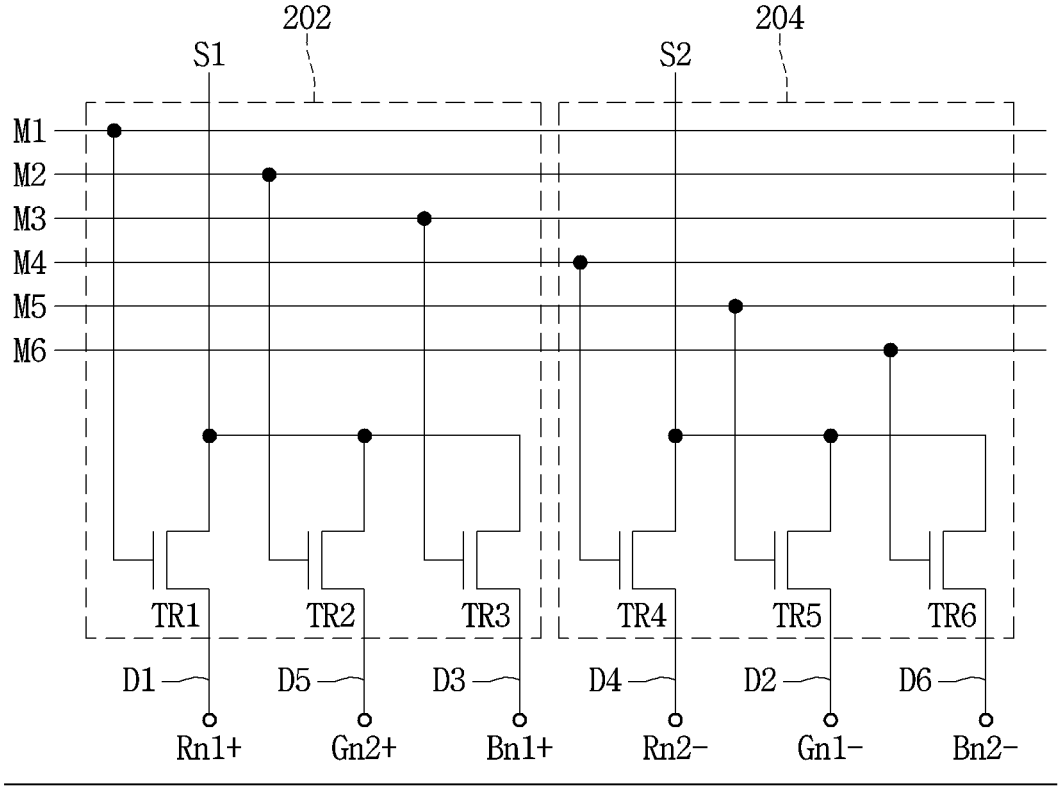
FIG. 5 is a circuit diagram showing in detail the selection circuit shown in FIG. 1.

As shown in FIG. 5, the first selection cell 202 can include first through third switches TR1 through TR3. Also, the second selection cell 204 can include fourth through sixth switches TR4 through TR6.

Figure 6:
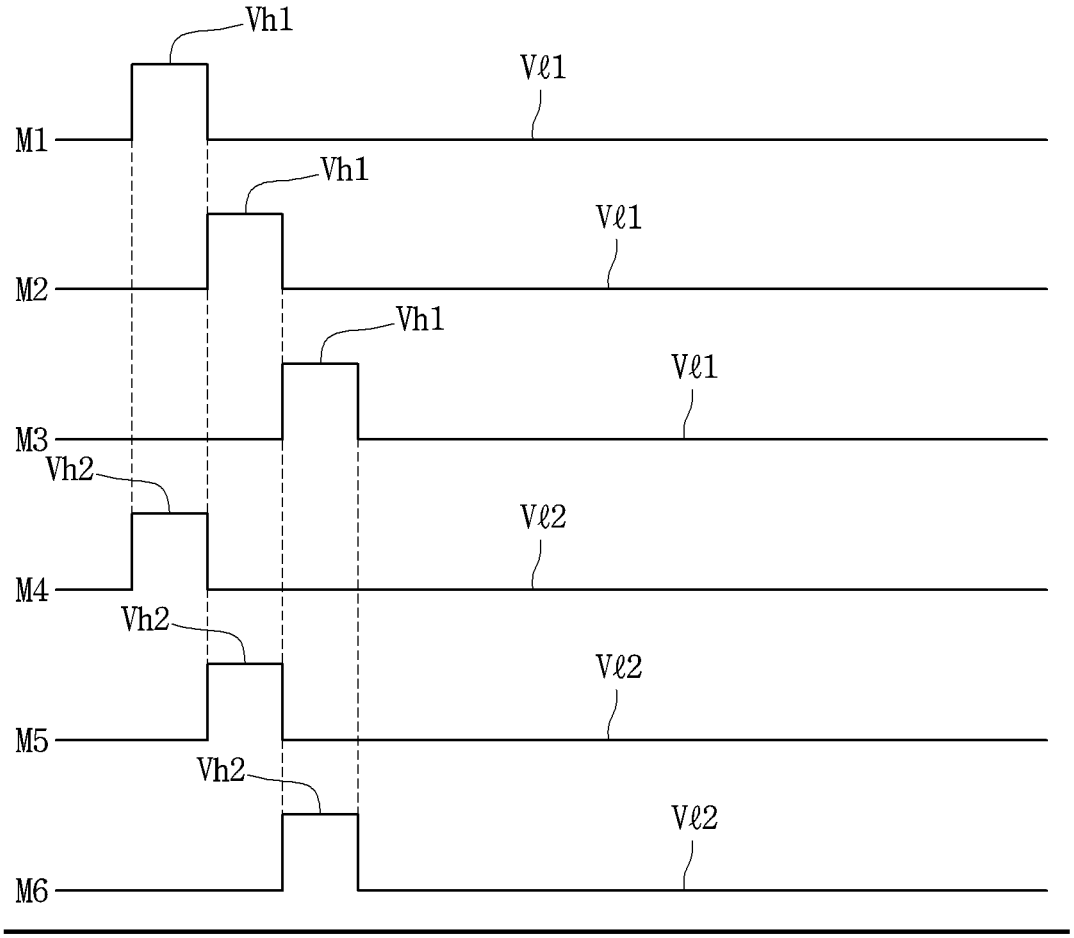
FIG. 6 is a waveform diagram showing selection control signals applied to the selection circuit shown in FIG. 1.

The first through sixth switches TR1~TR6 can be turned by the first through sixth selection control signals M1~M6 with a high logic pulse, as shown in FIG. 6. The first through third selection control signals M1~M3 can be sequentially applied to the first through third switches TR1~TR3. Also, the fourth through sixth selection control signals M4~M6 can be sequentially applied to the fourth through sixth switches TR4~TR6. As such, the first through third switches TR1~TR3 can be sequentially turned-on, and the fourth through sixth switches TR4~TR6 can be sequentially turned-on. If one of the three switches TR1~TR3 of the first selection sell 202 is turned-on, the other two can be turned-off. When one of the switches TR4~TR6 is turned-on, the other two can be turned-off. Moreover, the fourth through sixth selection control signals M4~M6 can be simultaneously generated with the first through third selection control signals M1~M3. In accordance therewith, the first selection cell 202 and the second selection cell 204 can simultaneously perform the time-division operation and the multiplexing operation for the data voltages. In detail, the first switch TR1 can be turned-on for a high level interval of the first selection control signal M1 and then turned-off. Continuously, the second switch TR2 can be turned-on for a high level interval of the second selection control signal M2 and then turned-off. Subsequently, the third switch TR3 can be turned-on for a high level interval of the third selection control signal M3 and then turned-off. Meanwhile, the fourth switch TR4 can be turned-on for a high level interval of the fourth selection control signal M4 and then turned-off. Continuously, the fifth switch TR5 can be turned-on for a high level interval of the fifth selection control signal M5 and then turned-off. Subsequently, the sixth switch TR6 can be turned-on for a high level interval of the sixth selection control signal M6 and then turned-off.

The first through sixth switches TR1~TR6 can be thin film transistors. In detail, each of the first through sixth switches TR1~TR6 can be one of PMOS and NMOS transistors.

The first switch TR1 can include a gate electrode connected to a first selection control signal line, a source electrode connected to the first source line S1 and a drain electrode connected to the first data line D1. The first switch TR1 can be turned-on in response to the first selection control signal M1 with a high level pulse which is applied from the first selection control signal line. Then, the first positive red data voltage Rn1+ on the first source line S1 can be transferred to the first data line D1 via the first switch TR1.

The second switch TR2 can include a gate electrode connected to a second selection control signal line, a source electrode connected to the first source line S1 and a drain electrode connected to the fifth data line D5. The second switch TR2 can be turned-on in response to the second selection control signal M2 with a high level pulse which is applied from the second selection control signal line. Then, the second positive green data voltage Gn2+ on the first source line S1 can be transferred to the fifth data line D5 via the second switch TR2.

The third switch TR3 can include a gate electrode connected to a third selection control signal line, a source electrode connected to the first source line S1 and a drain electrode connected to the third data line D3. The third switch TR3 can be turned-on in response to the third selection control signal M3 with a high level pulse which is applied from the third selection control signal line. Then, the first positive blue data voltage Bn1+ on the first source line S1 can be transferred to the third data line D3 via the third switch TR3.

The fourth switch TR4 can include a gate electrode connected to a fourth selection control signal line, a source electrode connected to the second source line S2 and a drain electrode connected to the fourth data line D4. The fourth switch TR4 can be turned-on in response to the fourth selection control signal M4 with a high level pulse which is applied from the fourth selection control signal line. Then, the second negative red data voltage Rn2− on the second source line S2 can be transferred to the fourth data line D4 via the fourth switch TR4.

The fifth switch TR5 can include a gate electrode connected to a fifth selection control signal line, a source electrode connected to the second source line S2 and a drain electrode connected to the second data line D2. The fifth switch TR5 can be turned-on in response to the fifth selection control signal M5 with a high level pulse which is applied from the fifth selection control signal line. Then, the first negative green data voltage Gn1− on the second source line S2 can be transferred to the second data line D2 via the fifth switch TR5.

The sixth switch TR6 can include a gate electrode connected to a sixth selection control signal line, a source electrode connected to the second source line S2 and a drain electrode connected to the sixth data line D6. The sixth switch TR6 can be turned-on in response to the sixth selection control signal M6 with a high level pulse which is applied from the sixth selection control signal line. Then, the second negative blue data voltage Bn2− on the second source line S2 can be transferred to the sixth data line D6 via the sixth switch TR6.

The source electrodes of the first through third switches TR1~TR3 can be commonly connected to the first source line S1. As such, the data voltage on the first source line S1 can be commonly applied to the first through third switches TR1~TR3. However, only one of the first through third switches TR1~TR3 is turned-on. In accordance therewith, the data voltage applied from the first source line S1 can be transferred to a data line connected to the drain electrode of the turned-on switch.

The source electrodes of the fourth through sixth switches TR4~TR6 can be commonly connected to the second source line S2. As such, the data voltage on the second source line S2 can be commonly applied to the fourth through sixth switches TR4~TR6. However, only one of the fourth through sixth switches TR4~TR6 is turned-on. In accordance therewith, the data voltage applied from the second source line S2 can be transferred to a data line connected to the drain electrode of the turned-on switch.

Referring to FIG. 6, the first through third selection control signals M1~M3 each have a first pulse swinging between a first low level voltage Vl1 (hereinafter, 'first low voltage Vl1') and a first high level voltage Vh1 (hereinafter, 'first high voltage Vh1'). On the other hand, the fourth through sixth selection control signals M4~M6 each have a second pulse swinging between a second low level voltage Vl2 (hereinafter, 'second low voltage Vl2') and a second high level voltage Vh2 (hereinafter, 'second high voltage Vh2').

Figure 7:
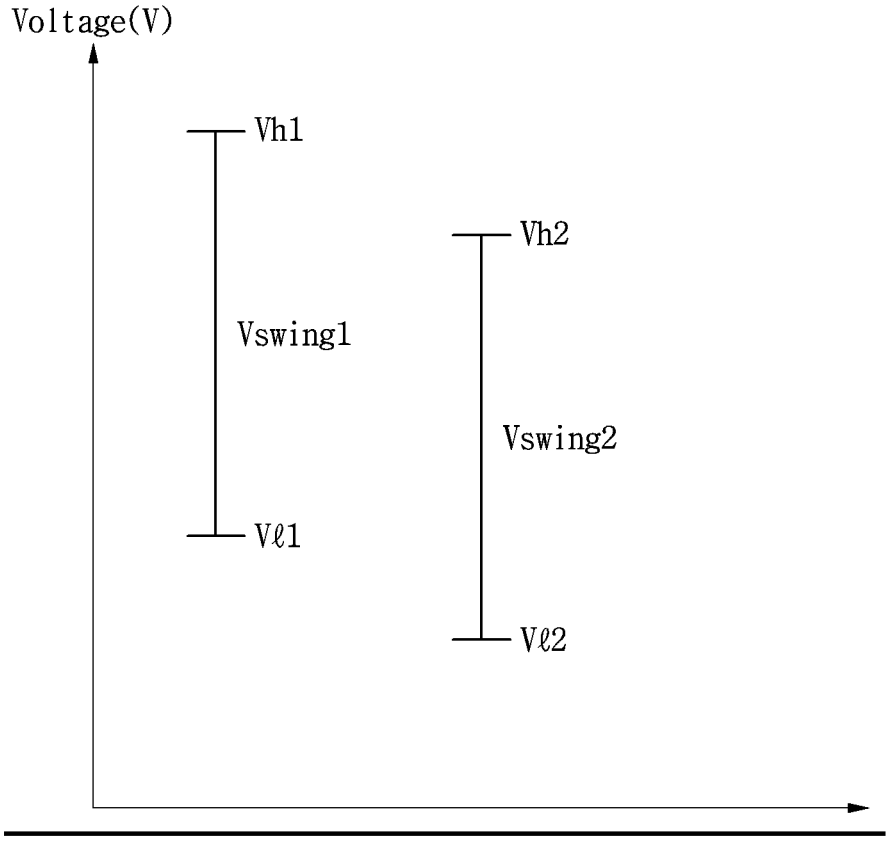
FIG. 7 is a graphic diagram illustrating swing widths of selection control signals applied to the selection circuit shown in FIG. 1.

As shown in FIG. 7, the first low voltage Vl1 of the first through third selection control signals M1~M3 is different from the second low voltage Vl2 of the fourth through sixth selection control signals M4~M6. Also, the first high voltage Vh1 of the first through third selection control signals M1~M3 is different from the second high voltage Vh2 of the fourth through sixth selection control signals M4~M6.

For example, the second low voltage Vl2 of each of the fourth through sixth selection control signals M4~M6 can be lower than the first low voltage Vl1 of each of the first through third selection control signals M1~M3. Also, the first high voltage Vh1 of each of the first through third selection control signals M1~M3 can be higher than the second high voltage Vh2 of each of the fourth through sixth selection control signals M4~M6.

A first swing width Vswing1 between the first low and high voltages Vl1 and Vh1 of each of the first through third selection control signals M1~M3 can be the same as a second swing width Vswing2 between the second low and high voltages Vl2 and Vh2 of each of the fourth through sixth selection control signals M4~M6. However, the swing width relationship is not limited to this.

As described above, the positive data voltages Rn1+, Gn2+ and Bn1+ can be applied to the source electrodes of the first through third switches TR1~TR3 included in the first selection cell 202, and the first through third selection control signals M1~M3 can be applied to the gate electrodes of the first through third switches TR1~TR3. As such, the first high voltage Vh1 of each of the first through third selection control signals M1~M3 must be higher than a high level of each of the positive data voltages Rn1+, Gn2+ and Bn1+, but the first low voltage Vl1 of each of the first through third selection control signals M1~M3 must be lower than or the same as a low level of each of the positive data voltages Rn1+, Gn2+ and Bn1+. The high level of each of the positive data voltages Rn1+, Gn2+ and Bn1+ corresponds to a gray level of an image which is displayed at the respective sub-pixel of the pixel array 104. In this case, in order to turn-on or turn-off the first through third switches TR1~TR3, the first high voltage Vh1 of each of the first through third selection control signals M1~M3 applied to the gate electrodes of the first through third switches TR1~TR3 must be higher than the high level of each of the positive data voltages Rn1+, Gn2+ and Bn1+, but the first low voltage Vl1 of each of the first through third selection control signals M1~M3 can be the same as the low level of each of the positive data voltages Rn1+, Gn2+ and Bn1+.

For example, if the high and low levels of each of the positive data voltages Rn1+, Gn2+ and Bn1+ are +5V and −5V, the first low voltage Vl1 of each of the first through third selection control signals M1~M3 can be the same −5V as the low level of each of the positive data voltages Rn1+, Gn2+ and Bn1+. The first high voltage Vh1 of each of the first through third selection control signals M1~M3 can be a higher voltage of +9V than the high level of +5V of each of the positive date voltage Rn1+, Gn2+ and Bn1+. However, the first low and high voltages Vl1 and Vh1 of each of the first through third selection control signals M1~M3 are not limited to these.

On the other hand, the negative data voltages Rn2−, Gn1− and Bn2− can be applied to the source electrodes of the fourth through sixth switches TR4~TR6 included in the second selection cell 204, and the fourth through sixth selection control signals M4~M6 can be applied to the gate electrodes of the fourth through sixth switches TR4~TR6. As such, the second high voltage Vh2 of each of the fourth through sixth selection control signals M4~M6 can be higher than or the same as a high level of each of the negative data voltages Rn2−, Gn1− and Bn2−, but the second low voltage Vl2 of each of the fourth through sixth selection control signals M4~M6 must be lower than a low level of each of the negative data voltages Rn2−, Gn1− and Bn2−. The low level of each of the negative data voltages Rn2−, Gn1− and Bn2− corresponds to a gray level of an image which is displayed at the respective sub-pixel of the pixel array 104. In this case, in order to turn-on or turn-off the fourth through sixth switches TR4~TR6, the second low voltage high voltage Vl2 of each of the fourth through sixth selection control signals M4~M6 applied to the gate electrodes of the fourth through sixth switches TR4~TR6 must be lower than the low level of each of the negative data voltages Rn2−, Gn1− and Bn2−, but the second high voltage Vh2 of each of the fourth through sixth selection control signals M4~M6 can be the same as the high level of each of the negative data voltages Rn2−, Gn1− and Bn2−.

For example, if the high and low levels of each of the negative data voltages Rn2−, Gn1− and Bn2− are +5V and −5V, the second low voltage Vl2 of each of the fourth through sixth selection control signals M4~M6 can be a lower voltage of −9V than the low level of −5V of each of the negative data voltages Rn2−, Gn1− and Bn2−. The second high voltage Vh2 of each of the fourth through sixth selection control signals M4~M6 can be the same +5V as the high level of each of the negative date voltage Rn2−, Gn1− and Bn2−. However, the second low and high voltages Vl2 and Vh2 of each of the fourth through sixth selection control signals M4~M6 are not limited to these.

Consequently, the present disclosure can allow the high voltage Vh1 or Vh2 and the low voltage Vl1 and Vl2 of the selection control signal M1, M2, M3, M4, M5 or M6 applied to each of the gate electrodes of the switches TR1~TR6 to be varied according to whether the positive data voltage Rn1+, Gn2+ or Bn1+ or the negative data voltage Rn2−, Gn1− or Bn2− is applied to each of the source electrodes of the switches TR1~TR6. However, the swing voltage width Vswing1 or Vswing2 between the high voltage Vh1 or Vh2 and the low voltage Vl1 or Vl2 of the selection control signal M1, M2, M3, M4, M5 or M6 can maintain the same width regardless of whether the positive data voltage Rn1+, Gn2+ or Bn1+ or the negative data voltage Rn2−, Gn1− or Bn2− is applied to each of the source electrodes of the switches TR1~TR6.

For example, the first low voltage Vl1 of the selection control signal M1, M2, M3, M4, M5 or M6 applied to each of the gate electrodes of the switches TR1~TR6 when the positive data voltage Rn1+, Gn2+ or Bn1+ is applied to each of the source electrodes of the switches TR1~TR6 can be higher than the second low voltage Vl2 of the selection control signal M1, M2, M3, M4, M5 or M6 applied to each of the gate electrodes of the switches TR1~TR6 when the negative data voltage Rn2−, Gn1− or Bn2− is applied to each of the source electrodes of the switches TR1~TR6. Similarly, the first high voltage Vh1 of the selection control signal M1, M2, M3, M4, M5 or M6 applied to each of the gate electrodes of the switches TR1~TR6 when the positive data voltage Rn1+, Gn2+ or Bn1+ is applied to each of the source electrodes of the switches TR1~TR6 can be higher than the second high voltage Vh2 of the selection control signal M1, M2, M3, M4, M5 or M6 applied to each of the gate electrodes of the switches TR1~TR6 when the negative data voltage Rn2−, Gn1− or Bn2− is applied to each of the source electrodes of the switches TR1~TR6.

Since the high and low voltages of the selection control signal M1, M2, M3, M4, M5 or M6 applied to each of the gate electrodes of the switches TR1~TR6 to be varied according to whether the positive data voltage Rn1+, Gn2+ or Bn1+ or the negative data voltage Rn2−, Gn1− or Bn2− is applied to each of the source electrodes of the switches TR1~TR6, the swing voltage width between the high and low voltages of the selection control signal M1, M2, M3, M4, M5 or M6 can be constantly maintained regardless of whether the positive data voltage Rn1+, Gn2+ or Bn1+ or the negative data voltage Rn2−, Gn1− or Bn2− is applied to each of the source electrodes of the switches TR1~TR6. In accordance therewith, undesired power consumption can be prevented. In other words, power consumption in the selection circuit 102 and the display device can be reduced.

Figure 8:
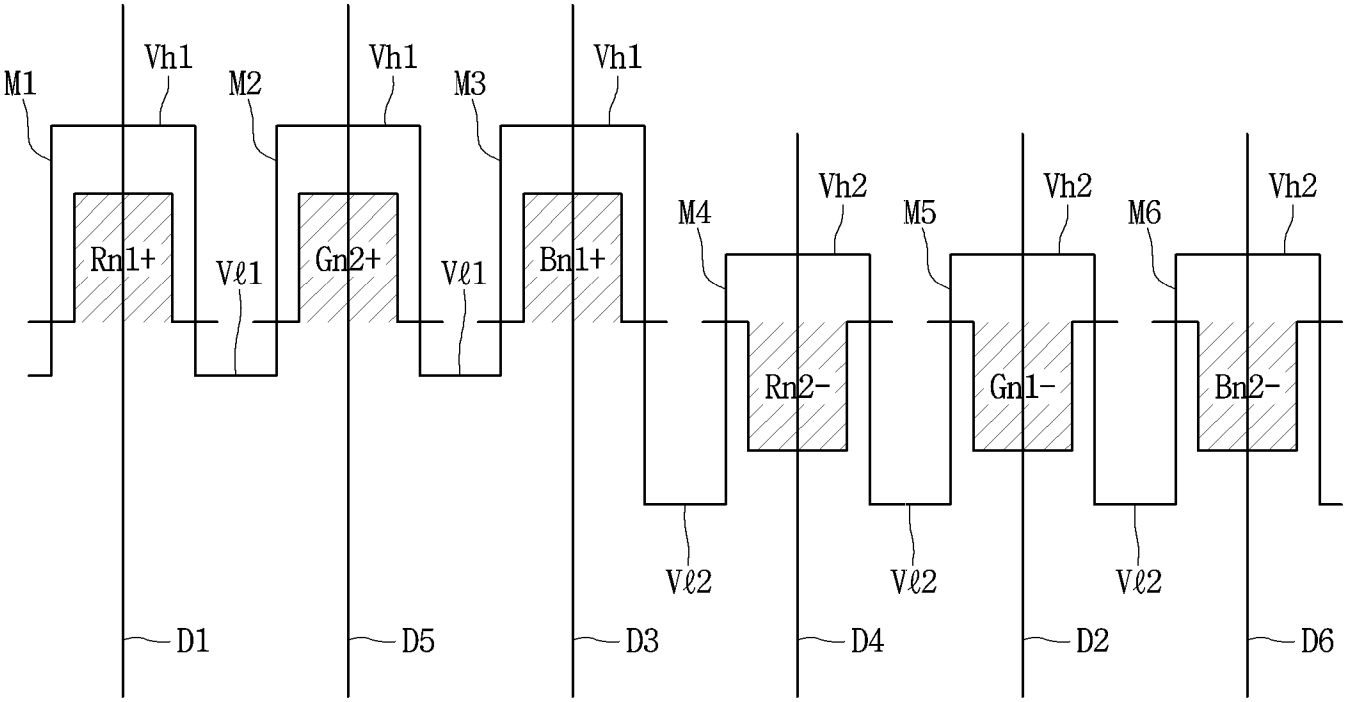
FIG. 8 is a waveform diagram illustrating relationships of selection signals, which are applied to the selection circuit, and data voltages selected by the selection control signals, according to an example of the present invention.

As shown in FIG. 8, the first switch TR1 of the first selection cell 202 can be turned-on in response to the first selection control signal M1 with the high level pulse swinging between the first low voltage Vl1 and the first high voltage Vh1. As such, the first positive red data voltage Rn1+ on the first source line S1 can be transferred to the first data line D1 via the turned-on first switch TR1.

Subsequently, the second switch TR2 of the first selection cell 202 can be turned-on in response to the second selection control signal M2 with the high level pulse swinging between the first low voltage Vl1 and the first high voltage Vh1. As such, the second positive green data voltage Gn2+ on the first source line S1 can be transferred to the fifth data line D5 via the turned-on second switch TR2.

Next, the third switch TR3 of the first selection cell 202 can be turned-on in response to the third selection control signal M3 with the high level pulse swinging between the first low voltage Vl1 and the first high voltage Vh1. As such, the first positive blue data voltage Bn1+ on the first source line S1 can be transferred to the third data line D3 via the turned-on third switch TR3.

The first low voltages Vl1 of the first through third selection control signals M1~M3 can be the same as one another. The first high voltages Vh1 of the first through third selection control signals M1~M3 can be the same as one another. However, the first low and high voltages Vl1 and Vh1 of each of the first through third selection control signals M1~M3 are not limited to these.

Meanwhile, the fourth switch TR4 of the second selection cell 204 can be turned-on in response to the fourth selection control signal M4 with the high level pulse swinging between the second low voltage Vl2 and the second high voltage Vh2. As such, the second negative red data voltage Rn2− on the second source line S2 can be transferred to the fourth data line D4 via the turned-on fourth switch TR4.

Continuously, the fifth switch TR5 of the second selection cell 204 can be turned-on in response to the fifth selection control signal M5 with the high level pulse swinging between the second low voltage Vl2 and the second high voltage Vh2. As such, the first negative green data voltage Gn1− on the second source line S2 can be transferred to the second data line D2 via the turned-on fifth switch TR5.

Subsequently, the sixth switch TR6 of the second selection cell 204 can be turned-on in response to the sixth selection control signal M6 with the high level pulse swinging between the second low voltage Vl2 and the second high voltage Vh2. As such, the second negative blue data voltage Bn2− on the second source line S2 can be transferred to the sixth data line D6 via the turned-on sixth switch TR6.

The second low voltages Vl2 of the fourth through sixth selection control signals M4~M6 can be the same as one another. The second high voltages Vh2 of the fourth through sixth selection control signals M4~M6 can be the same as one another. However, the second low and high voltages Vl2 and Vh2 of each of the fourth through sixth selection control signals M4~M6 are not limited to these.

The second low voltage Vl2 of each of the fourth through sixth selection control signals M4~M6 can be lower than the first low voltage Vl1 of each of the first through third selection control signals M1~M3. Also, the first high voltage Vh1 of each of the first through third selection control signals M1~M3 can be higher than the second high voltage Vh2 of each of the fourth through sixth selection control signals M4~M6.

Although the present disclosure has been limitedly explained regarding only the embodiments described above, it should be considered as examples without being limitedly interpreted to the embodiments. As such, the scope of the present disclosure shall be determined only by reasonably interpreting the appended claims and include various changes or modifications of the appended claims within the equivalent scope of the present disclosure.

What is claimed is:

1. A selection circuit comprising:

a first selection cell connected to first through third selection control signal lines, a first source line, and first, fifth and third data lines, and configured to time-divide a positive data voltage applied from the first source line and multiplex the positive data voltages to the first, fifth and third data lines, in response to first through third selection signals applied from the first through third selection control lines; and a second selection cell connected to fourth through sixth selection control signal lines, a second source line, and fourth, second and sixth data lines, and configured to time-divide a negative data voltage applied from the second source line and multiplex the negative data voltages to the fourth, second and sixth data lines, in response to fourth through sixth selection control signals applied from the fourth through sixth selection control signal lines, wherein each of the first through third selection control signals includes a first pulse swinging between a first low voltage and a first high voltage, each of the fourth through sixth selection control signals includes a second pulse swinging between a second low voltage and a second high voltage which are different from the first low voltage and the first high voltage, and wherein the second low voltage is lower than the first low voltage, and the first high voltage is higher than the second high voltage.

2. The selection circuit of claim 1, wherein the first selection cell includes:

a first switch connected to the first selection control signal line, the first source line and the first data line, and configured to transfer the positive data voltage from the first source line to the first data line in response to the first selection control signal on the first selection control signal line;

a second switch connected to the second selection control signal line, the first source line and the fifth data line, and configured to transfer the positive data voltage from the first source line to the fifth data line in response to the second selection control signal on the second selection control signal line; and a third switch connected to the third selection control signal line, the first source line and the third data line, and configured to transfer the positive data voltage from the first source line to the third data line in response to the third selection control signal on the third selection control signal line.

3. The selection circuit of claim 2, wherein the second selection cell includes:

a fourth switch connected to the fourth selection control signal line, the second source line and the fourth data line, and configured to transfer the negative data voltage from the second source line to the fourth data line in response to the fourth selection control signal on the fourth selection control signal line;

a fifth switch connected to the fifth selection control signal line, the second source line and the second data line, and configured to transfer the negative data voltage from the second source line to the second data line in response to the fifth selection control signal on the fifth selection control signal line; and a sixth switch connected to the sixth selection control signal line, the second source line and the sixth data line, and configured to transfer the negative data voltage from the second source line to the sixth data line in response to the sixth selection control signal on the sixth selection control signal line.

4. The selection circuit of claim 1, wherein the first pulse has a same swing width as the second pulse.

5. The selection circuit of claim 1, wherein the first through sixth data lines are driven in a column inversion mode by the positive and negative data voltages.

6. The selection circuit of claim 5, wherein:

the first data line receives a first positive red data voltage, the second data line receives a first negative green data voltage, the third data line receives a first positive blue data voltage, the fourth data line receives a second negative red data voltage, the fifth data line receives a second positive green data voltage, and the sixth data line receives a second negative blue data voltage.

7. The selection circuit of claim 1, wherein the first through sixth data lines are arranged adjacently to one another.

8. A display device comprising:

a display panel;

a pixel array disposed on a display area of the display panel, and configured to include first through sixth sub-pixels which are connected to first through sixth data lines;

a data driver connected to apply positive and negative data voltages to first and second source lines; and a selection circuit disposed on a non-display area, connected to the first and second source lines and the first through sixth data lines, and configured to include:

a first selection cell connected to first through third selection control signal lines, the first source line and the first, fifth and third data lines, and configured to time-divide the positive data voltage applied from the first source line and multiplex the positive data voltages to the first, fifth and third data lines, in response to first through third selection signals applied from the first through third selection control lines; and a second selection cell connected to fourth through sixth selection control signal lines, the second source line and the fourth, second and sixth data lines, and configured to time-divide the negative data voltage applied from the second source line and multiplex the negative data voltages to the fourth, second and sixth data lines, in response to fourth through sixth selection control signals applied from the fourth through sixth selection control signal lines, wherein each of the first through third selection control signals includes a first pulse swinging between a first low voltage and a first high voltage, each of the fourth through sixth selection control signals includes a second pulse swinging between a second low voltage and a second high voltage which are different from the first low voltage and the first high voltage, and wherein the second low voltage is lower than the first low voltage, and the first high voltage is higher than the second high voltage.

9. The display device of claim 8, wherein:

the first, third, fourth and sixth data lines are disposed to go straight from the first and second selection cells to the pixel array without crossing one another, and the second and fifth data lines are disposed to cross each other between the selection cells and the pixel array.

10. The display device of claim 8, wherein the first selection cell includes:

a first switch connected to the first selection control signal line, the first source line and the first data line, and configured to transfer the positive data voltage from the first source line to the first data line in response to the first selection control signal on the first selection control signal line;

a second switch connected to the second selection control signal line, the first source line and the fifth data line, and configured to transfer the positive data voltage from the first source line to the fifth data line in response to the second selection control signal on the second selection control signal line; and a third switch connected to the third selection control signal line, the first source line and the third data line, and configured to transfer the positive data voltage from the first source line to the third data line in response to the third selection control signal on the third selection control signal line.

11. The display device of claim 10, wherein the second selection cell includes:

a fourth switch connected to the fourth selection control signal line, the second source line and the fourth data line, and configured to transfer the negative data voltage from the second source line to the fourth data line in response to the fourth selection control signal on the fourth selection control signal line;

a fifth switch connected to the fifth selection control signal line, the second source line and the second data line, and configured to transfer the negative data voltage from the second source line to the second data line in response to the fifth selection control signal on the fifth selection control signal line; and a sixth switch connected to the sixth selection control signal line, the second source line and the sixth data line, and configured to transfer the negative data voltage from the second source line to the sixth data line in response to the sixth selection control signal on the sixth selection control signal line.

12. The display device of claim 8, wherein the first pulse has a same swing width as the second pulse.

13. The display device of claim 8, wherein the first through sixth data lines are driven in a column inversion mode by the positive and negative data voltages.

14. The display device of claim 13, wherein:

the first data line receives a first positive red data voltage, the second data line receives a first negative green data voltage, the third data line receives a first positive blue data voltage, the fourth data line receives a second negative red data voltage, the fifth data line receives a second positive green data voltage, and the sixth data line receives a second negative blue data voltage.

* * * * *